US007605792B2

(12) United States Patent
Son et al.

(10) Patent No.: US 7,605,792 B2
(45) Date of Patent: Oct. 20, 2009

(54) DRIVING METHOD AND CIRCUIT FOR AUTOMATIC VOLTAGE OUTPUT OF ACTIVE MATRIX ORGANIC LIGHT EMITTING DEVICE AND DATA DRIVE CIRCUIT USING THE SAME

(75) Inventors: Young-Suk Son, Hwasung (KR); Sang-Kyung Kim, Daejeon (KR); Gyu-Hyeong Cho, Gongju-si (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 689 days.

(21) Appl. No.: 11/367,864

(22) Filed: Mar. 3, 2006

(65) Prior Publication Data

US 2006/0290621 A1 Dec. 28, 2006

(30) Foreign Application Priority Data

Jun. 28, 2005 (KR) ..... 10-2005-0056460

(51) Int. Cl.
*G09G 3/36* (2006.01)

(52) U.S. Cl. ..... 345/98; 345/99; 345/94; 345/82; 345/77; 345/208; 315/169.1; 315/169.3; 315/291; 315/360

(58) Field of Classification Search ... 315/169.1–169.3, 315/291, 307, 360; 345/76, 77, 82, 90, 92, 345/94, 98, 99, 102, 208, 212, 690
See application file for complete search history.

(56) References Cited

U.S. PATENT DOCUMENTS 6,795,045 B2 9/2004 Jang et al.
7,038,651 B2 * 5/2006 Nitta et al. ..... 345/98
7,474,288 B2 * 1/2009 Smith et al. ..... 345/83
2005/0083270 A1 * 4/2005 Miyazawa ..... 345/76
2007/0080905 A1 * 4/2007 Takahara ..... 345/76

OTHER PUBLICATIONS

An article entitled, "New Pixel-Driving Scheme with Data-Line . . . ", By M. Shimoda et al., IDW '02 pp. 239-242 (2002).

* cited by examiner

*Primary Examiner*—Haissa Philogene
(74) *Attorney, Agent, or Firm*—Bachman & LaPointe, P.C.

(57) ABSTRACT

Disclosed herein is a driving method and circuit for the automatic voltage output of an active matrix organic light emitting device, which is capable of resolving the non-uniformity of brightness between pixels. The circuit of the present invention includes timing generation means for generating a data drive start signal; sweep voltage generation means for generating a sweep voltage signal in response to output of the timing generation means; current level detection means for sensing an amount of current, which flows into pixels, based on output of the sweep voltage generation means, and outputting a sensing result to a data line; comparison means for comparing output of the current level detection means with a reference signal that determines stop timing for data writing, and outputting a comparison result; and data writing start/end control signal generation means for starting to operate in response to the output of the timing generation means, and generating data writing start and end control signals to a program stop line of a display panel. The invention can shorten data writing time and improve the precision of data writing. Furthermore, the present invention can simplify a data drive circuit and achieve the uniformity of brightness between pixels.

8 Claims, 9 Drawing Sheets

[Figure 1]
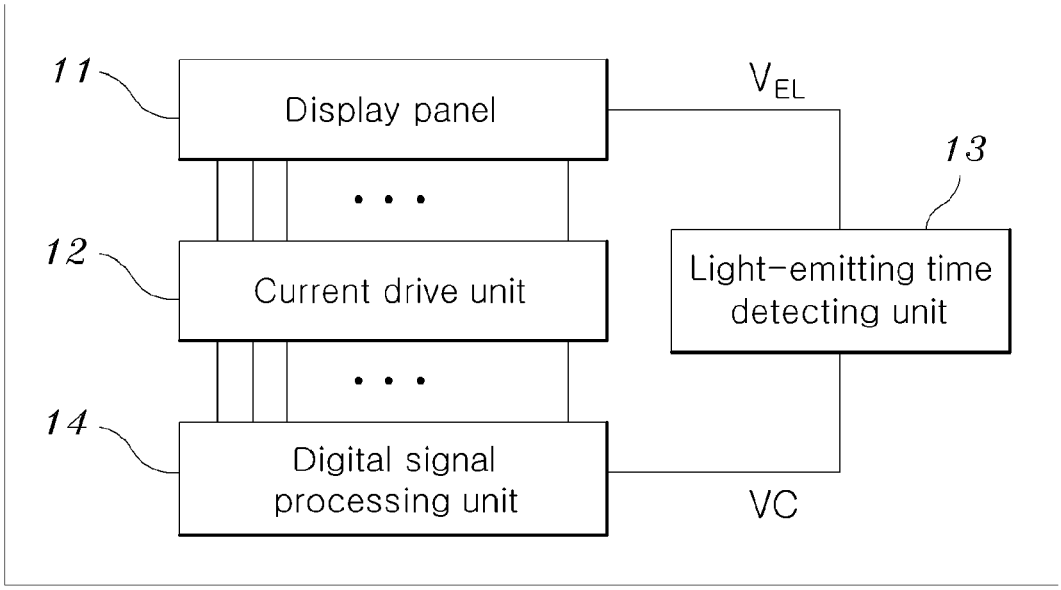
PRIOR ART

[Figure 2]
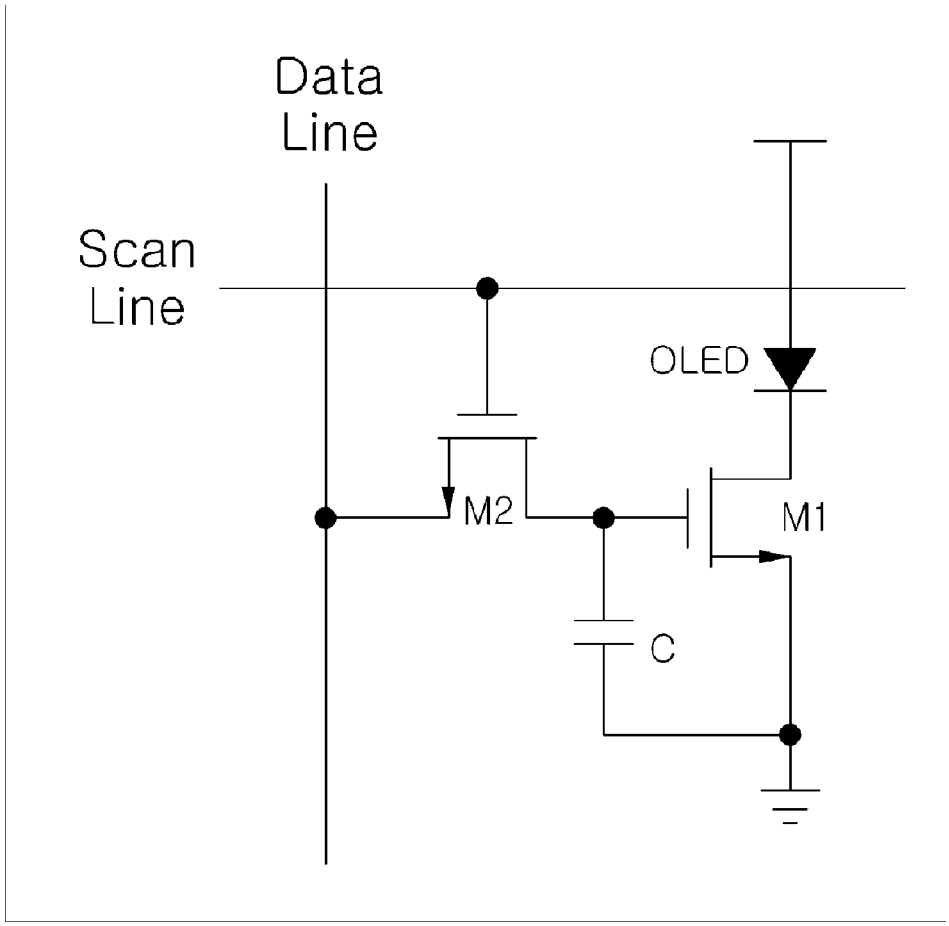
PRIOR ART

[Figure 3]
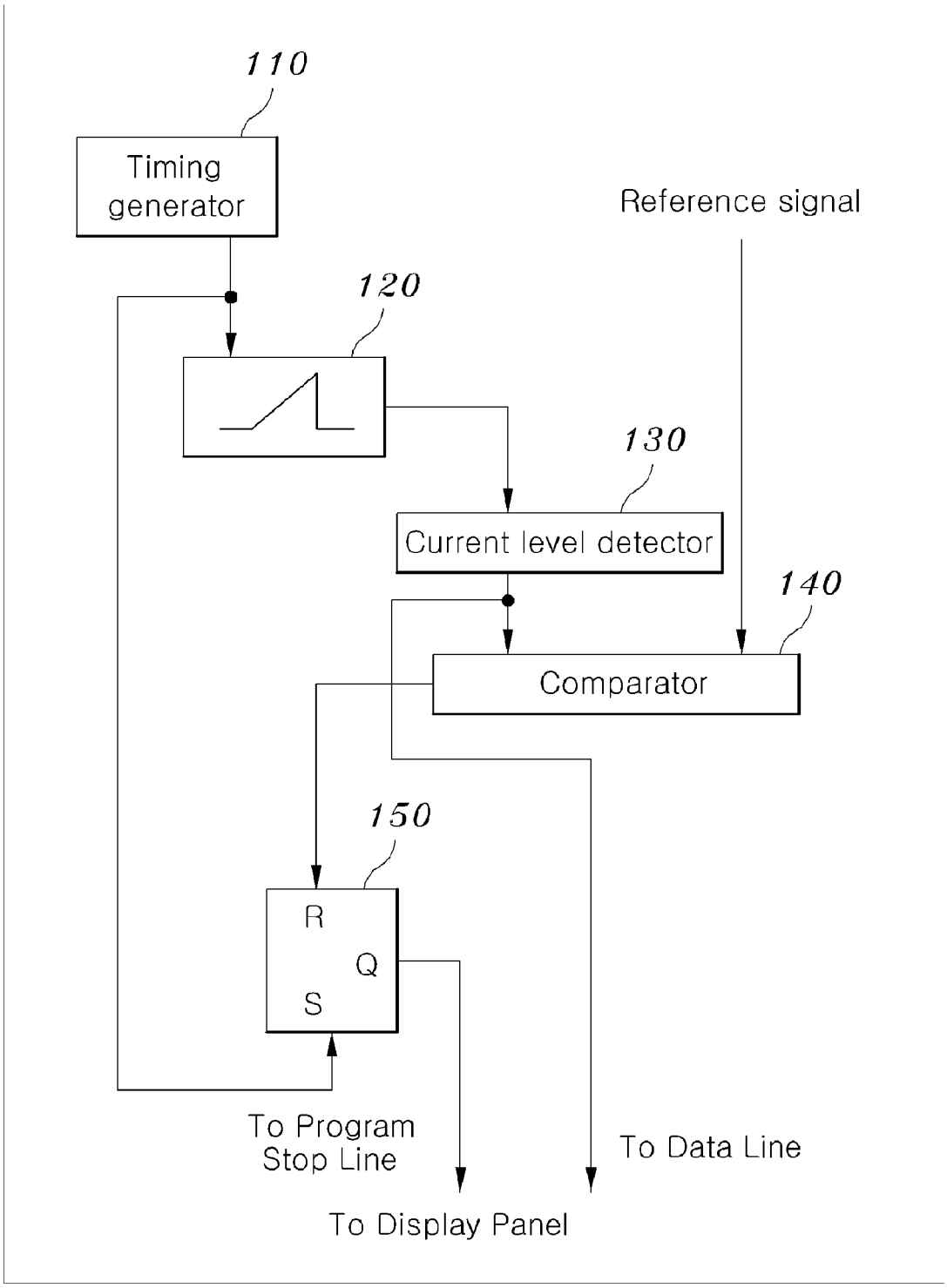

[Figure 4]
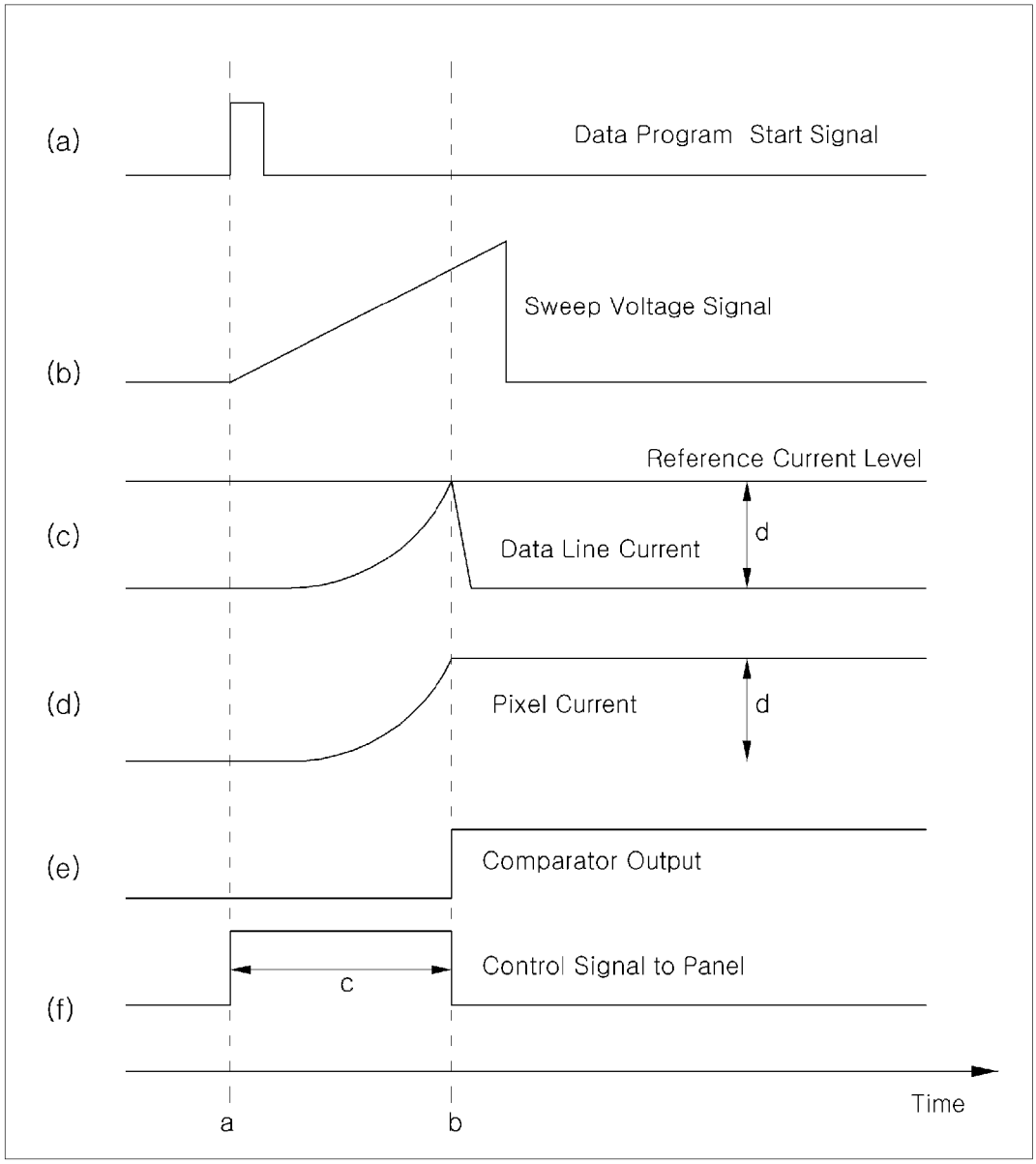

[Figure 5]
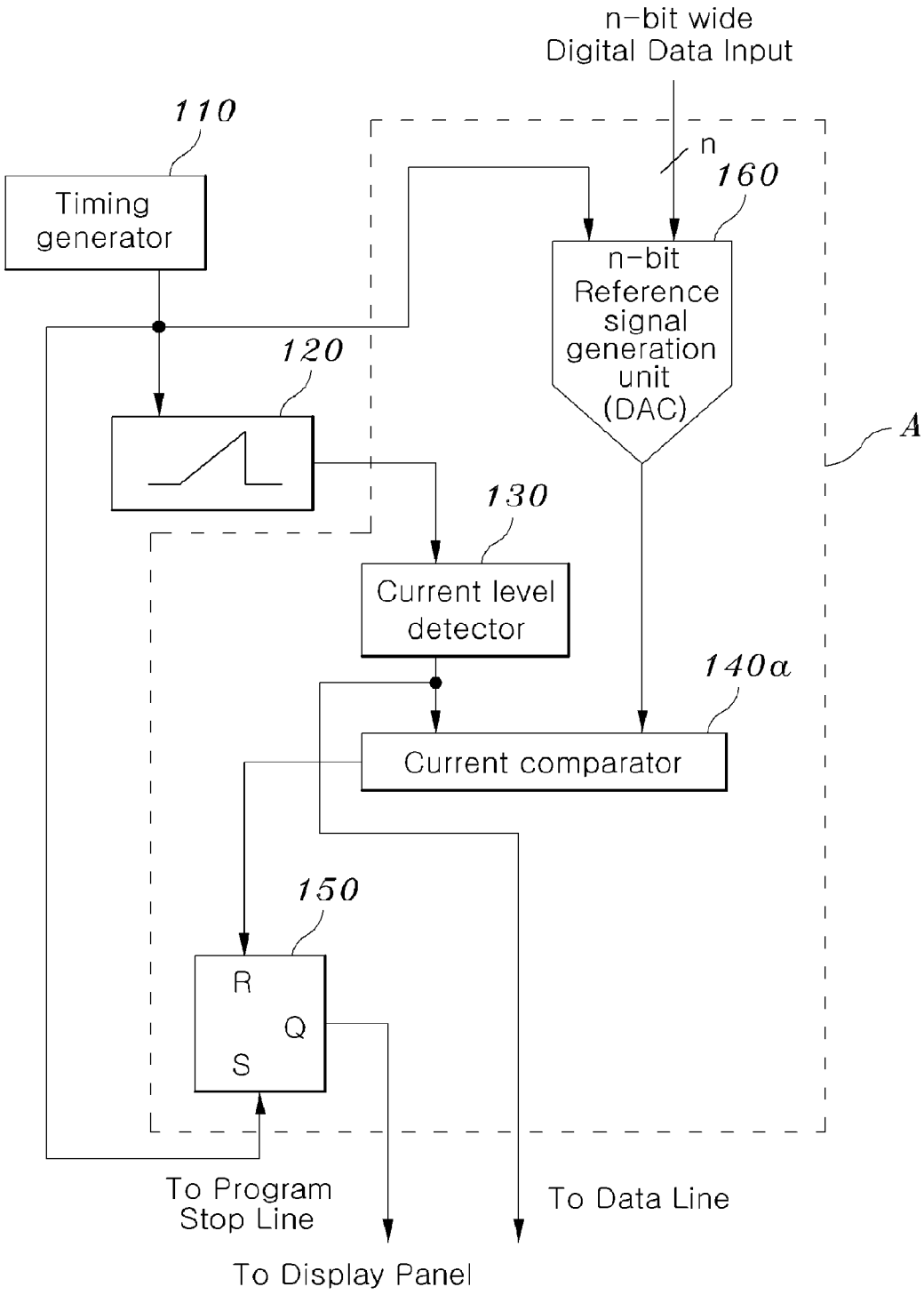

[Figure 6]
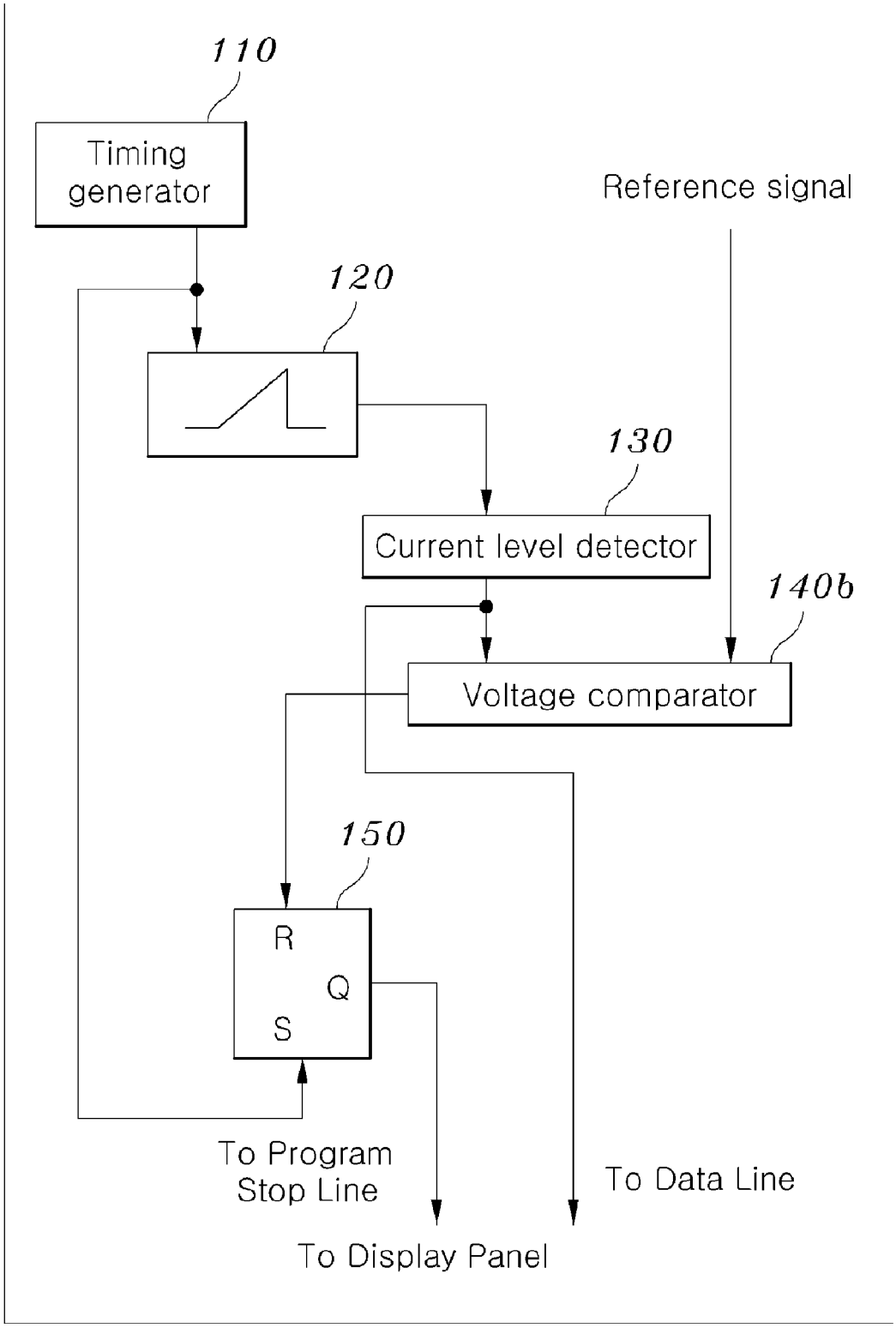

[Figure 7]
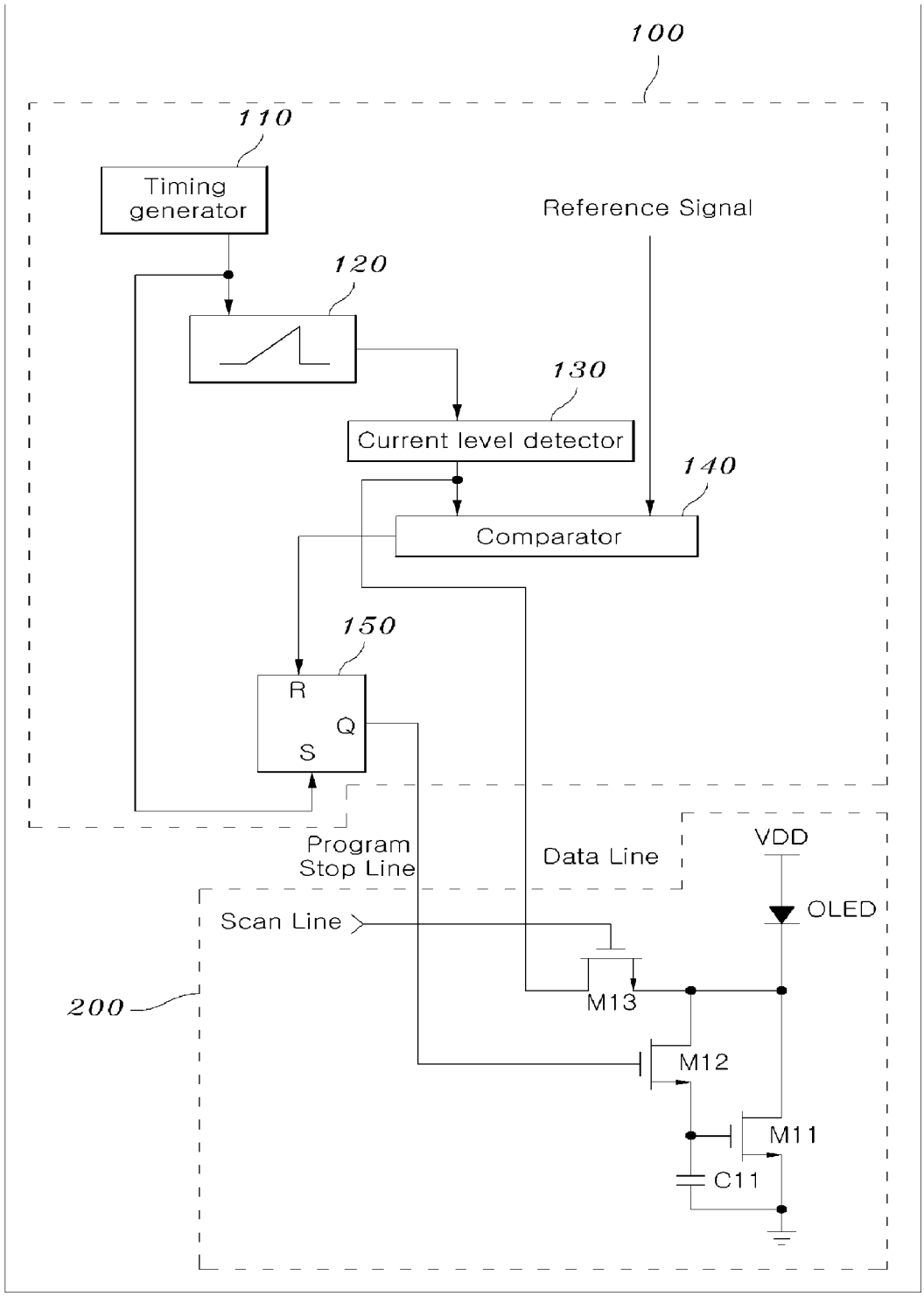

[Figure 8]
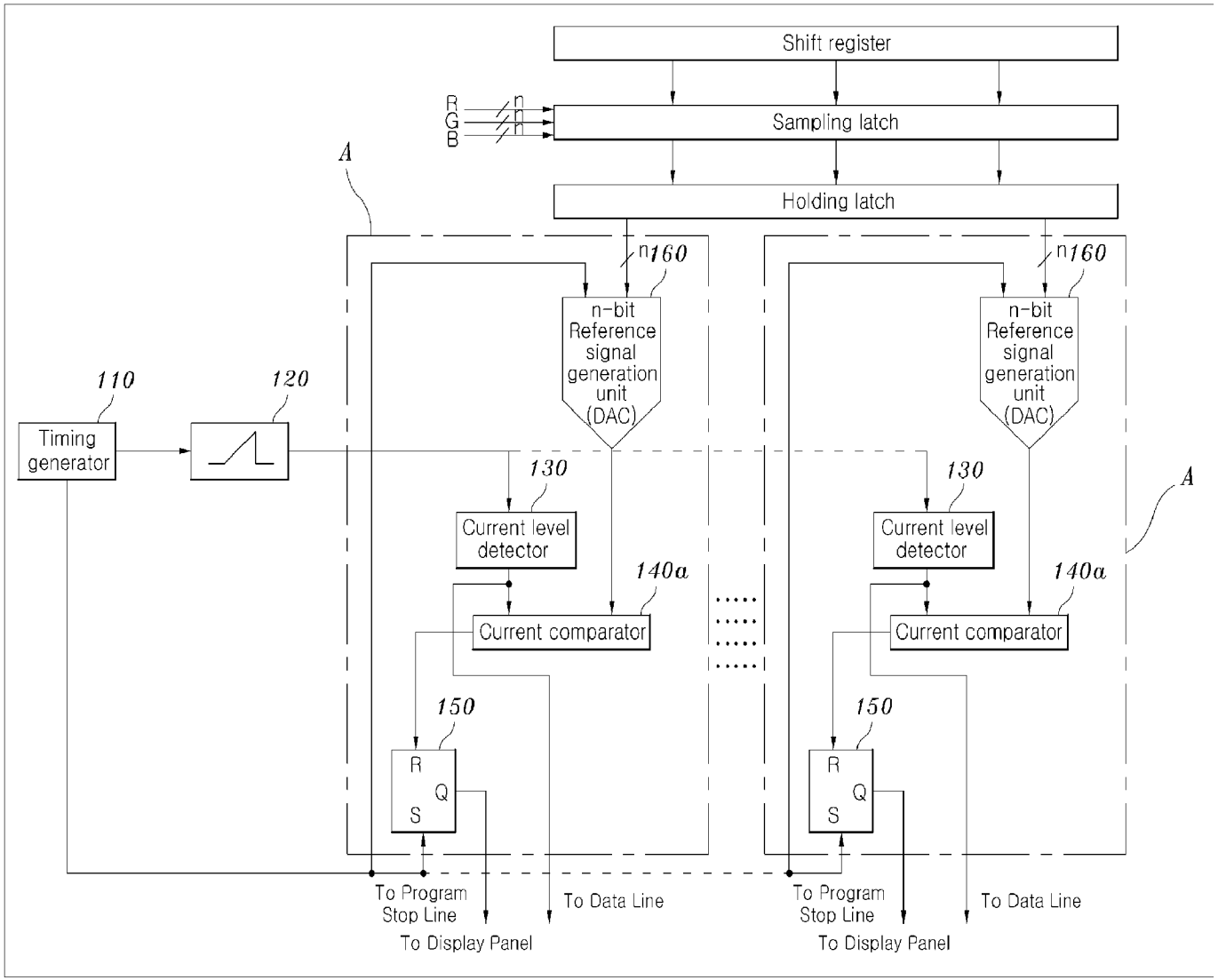

[Figure 9]
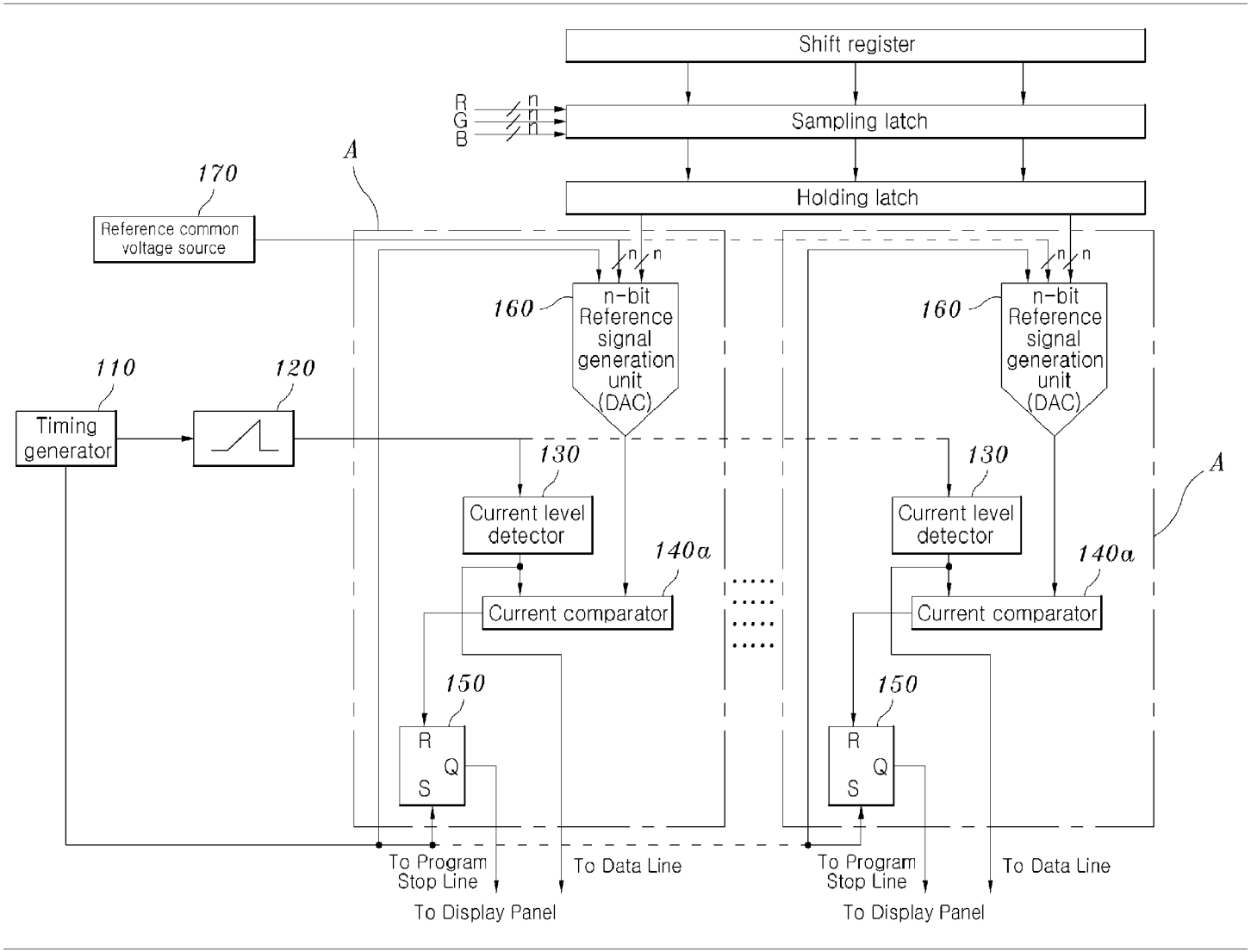

DRIVING METHOD AND CIRCUIT FOR AUTOMATIC VOLTAGE OUTPUT OF ACTIVE MATRIX ORGANIC LIGHT EMITTING DEVICE AND DATA DRIVE CIRCUIT USING THE SAME

BACKGROUND OF THE INVENTION

1. Field of the Invention

The present invention relates generally to a driving circuit for a flat panel display device and, more particularly, to a driving method and circuit for the automatic voltage output of an active matrix organic light emitting device, which is capable of resolving the non-uniformity of brightness between pixels, that is, a great problem in a flat panel display using the active-matrix organic light emitting device, and a data drive circuit using the same.

2. Description of the Related Art

Technologies for forming a Thin Film Transistor (TFT) on a substrate have been widely developed for the past several years, and applications of the technologies to an active-matrix display device are being developed.

Particularly, since a TFT using a poly-silicon film has field-effect mobility higher than that of a conventional TFT using an amorphous silicon film, the TFT using the poly-silicon film can operate at a high speed.

As a result, pixel control, which was conventionally performed by a drive circuit located outside a substrate, can be performed by a drive circuit formed on the same substrate as pixels.

Such a type of active-matrix display device has been focused on because of its many advantages, such as low manufacturing cost, the miniaturization of the display device, high yield, and high throughput, that can all be acquired by integrating various circuits and devices on the same substrate.

Currently, active-matrix Electro-Luminescent (EL) display devices having EL devices as self-light-emitting devices are actively being studied. An EL display device is also called an Organic EL Display (OELD) or an Organic Light Emitting Device (OLED), while an Active-Matrix Organic Light Emitting Device is called an AMOLED.

Unlike liquid crystal display devices, an organic display device is a self-emitting type. An EL device is constructed such that EL layers are interposed between a pair of electrodes. When electrons and holes are respectively injected to the EL layers, which are formed between a first electrode (negative), that is, an electron-injection electrode (cathode), and a second electrode (positive), that is, a hole-injection electrode (anode), the electrons and the holes are respectively combined to form electron-hole pairs and then create excitons. The created excitons disappear while transitioning from a excited state to a ground state, thereby emitting light.

Such an OLED operates with a bias of 2 to 30 volts. The brightness of the OLED can be controlled by adjusting voltage or current applied to the anode and cathode thereof. The relative amount of generated light is called a gray level. In general, the OLED optimally operates in current mode.

Light output is more stabilized upon constant-current driving rather than upon constant-voltage driving. This stands a contrast to the operation of many other displays that operate in voltage mode. As a result, an active matrix display using the OLED technology requires a specific pixel structure in order to provide current operation mode.

Generally, in a matrix address OLED device, a plurality of OLEDs is formed on a single substrate and is arranged in regular grid pattern groups. The several OLED groups, which form a grid column, can share a common cathode or a cathode line. The several OLED groups, which form a grid row, can share a common anode or an anode line.

Respective OLEDs of a predetermined group emit light when the cathode and anode lines thereof are simultaneously activated. Each OLED group of a matrix may form one pixel of a display, and each OLED acts as a sub-pixel or a pixel cell.

An OLED has excellent characteristics, such as a wide viewing angle, fast response and high contrast, so that it may be used as a pixel of a graphic display, a television video display or a surface light source. Furthermore, the OLED can be formed on a flexible transparent substrate, such as plastic, can be formed to be thin and light, and has good color sensitivity, so that it is suitable for a next-generation flat panel display.

Furthermore, the OLED can represent 3 colors, that is, red (R), green (G) and blue (B), and does not require backlight, as opposed to the well-known Liquid Crystal Display (LCD), thereby decreasing power consumption. The OLED has good color sensitivity, so that it attracts attention as a full-color display.

FIG. 1 is a schematic block diagram illustrating a conventional data drive circuit disclosed in U.S. Pat. No. 6,795,045. The conventional data drive circuit includes a current drive unit 12 for supplying constant current to a panel 11, a light-emitting time detecting unit 13 for detecting light-emitting time and a digital signal processing unit 14 for controlling the light-emitting time.

Furthermore, as illustrated in FIG. 2, a conventional basic pixel circuit (disclosed in U.S. Pat. No. 5,684,365) includes a drive transistor M1, a data line, a switch transistor M2, a data storing capacitor C and an OLED.

In the conventional data drive circuit of FIG. 1, a method of detecting voltages generated in respective pixels by drive current, comparing the detected voltages with a reference voltage, and defining light-emitting time based on comparison results in order to detect the light-emitting time, was proposed.

However, it is well known that voltage-current characteristics of drive transistors, which constitute respective pixels, differ from each other. This implies that, when different pixels are driven with the same current, voltages, which are induced in the drive transistors of respective pixels, differ from each other. Furthermore, it is impossible that the induced voltages are used as the brightness information of the pixels unless they are used upon digital driving.

Furthermore, in the AMOLED pixel circuit of FIG. 2, a basic principal of data driving is to control brightness using the amount of current which flows through the OLED. As in FIG. 1, the determination of the brightness of an OLED based on the detection of the voltage of a data line is possible only when the voltage-current characteristics of drive transistors, which constitute respective pixels, are identical to each other. In fact, the voltage-current characteristics of drive transistors are different.

As a result, in order to control the amounts of current, which flows through the OLEDs of respective pixels, to be uniform, it is necessary to directly monitor and control current on data lines.

That is, a principal cause of the non-uniformity of brightness (such as panel-to-panel non-uniformity, and pixel-to-pixel non-uniformity in a panel) in a flat panel display using AMOLEDs is that the drive transistors of respective pixels, constituting the flat panel display, have different characteristics depending on pixels and the characteristics randomly vary over time.

As a result, a solution to the non-uniformity of the drive transistors constituting respective pixels has been sought to achieve the uniformity of the brightness of a flat panel display.

SUMMARY OF THE INVENTION

Accordingly, the present invention has been made keeping in mind the above problems occurring in the prior art, and an object of the present invention is to provide a driving method and circuit for the automatic voltage output of an active matrix organic light emitting device, which monitors the amount of current applied to each pixel through a data line, and, when the amount of current reaches a target value, feeds back a control signal to a pixel circuit to stop a data program, so that currents which drive OLEDs can be controlled to be equal even though the voltage-current characteristics of transistors, which drive the OLEDs of respective pixels, are different from each other, thereby achieving the uniformity of brightness between the pixels.

Another object of the present invention is to provide a driving method and circuit for the automatic voltage output of an active matrix organic light emitting device, which uses a voltage source as a data drive signal source in order to increase data drive speed, which was the problem of the conventional current drive method, and enhances the current drive capability of the voltage source in order to increase data drive speed.

In order to accomplish the above object, the present invention provides a driving method for automatic voltage output of an Organic Light Emitting Device (OLED), comprising the steps of sensing a writing state of current via a data line when writing current via the data line of display pixels using sweep voltage signals; and outputting control signals to the respective pixels based on amounts of the current sensed in real time, thereby driving the pixels at intended current levels.

Furthermore, the present invention provides a driving circuit for automatic voltage output of an OLED, comprising timing generation means for generating a data drive start signal; sweep voltage generation means for generating a sweep voltage signal in response to output of the timing generation means; current level detection means for sensing an amount of current, which flows into pixels, based on output of the sweep voltage generation means, and outputting a sensing result to a data line; comparison means for comparing output of the current level detection means with a reference signal that determines stop timing for data writing, and outputting a comparison result; and data writing start/end control signal generation means for starting to operate in response to the output of the timing generation means, and generating data writing start and end control signals to a program stop line of a display panel.

According to the present invention, in a data drive circuit to which the drive circuit is applied, when reference signals of respective channels are current signals, the respective channels generate reference current signals depending on n-bit digital data inputs of the respective channels, and current drive levels of pixels are set to the respective reference current signal levels.

According to the present invention, in a data drive circuit to which the drive circuit is applied, when reference signals of respective channels are voltage signals, outputs of a reference common voltage source, having a plurality of outputs, are selected by the channels and then the reference signals of the channels are independently selected.

BRIEF DESCRIPTION OF THE DRAWINGS

The above and other objects, features and advantages of the present invention will be more clearly understood from the following detailed description taken in conjunction with the accompanying drawings, in which:

FIG. 1 is a schematic block diagram of a conventional data drive circuit;

FIG. 2 is a diagram of a conventional basic pixel circuit;

FIG. 3 is a diagram illustrating the conceptual construction of a driving circuit for the automatic voltage output of an active matrix organic light emitting device according to the present invention;

FIGS. 4A to 4F are operation timing diagrams of FIG. 3;

FIG. 5 is a diagram illustrating an embodiment of a reference signal generation unit according to the present invention;

FIG. 6 is a diagram illustrating the case where the reference signal is used as voltage information;

FIG. 7 is a diagram illustrating an embodiment in which the present invention is applied to a pixel circuit;

FIG. 8 is a diagram illustrating an embodiment of a data drive circuit to which the drive circuit of the present invention is applied; and FIG. 9 is a diagram illustrating an application of FIG. 8.

DESCRIPTION OF THE PREFERRED EMBODIMENTS

Reference now should be made to the drawings, in which the same reference numerals are used throughout the different drawings to designate the same or similar components.

FIG. 3 is a diagram illustrating the conceptual construction of a driving circuit for the automatic voltage output of an active matrix organic light emitting device according to the present invention.

As illustrated in FIG. 3, the drive circuit includes a timing generator 110 for generating a data drive start signal, a sweep voltage generator 120 for generating a sweep voltage signal in response to the output of the timing generator 110, a current level detector 130 for sensing the amount of current, which flows into pixels, based on the output of the sweep voltage generator 120 and outputting a sensing result to a data line, a comparator 140 for comparing the output of the current level detector 130 with a reference signal which determines the stop timing for data writing and outputting a corresponding comparison result, and a data writing start/end control signal generator 150 having a set terminal that is set in response to the output of the timing generator 110, and a reset terminal that is controlled in response to the output of the comparator 140, so that data writing start and end control signals are generated to the program stop line of a display panel. In this case, the data writing start/end control signal generator 150 may be constructed using various types of logic circuits.

The present invention having the above-described construction is described with reference to the timing diagrams of FIGS. 4A to 4F, which conceptually illustrates an operation along a time axis when data is written into a pixel circuit at certain time.

First, when the data drive start signal is generated by the timing generator 110 at time "a" in FIG. 4F, the sweep voltage signal is applied from the sweep voltage generator 120 to the data line through the current level detector 130, and the applied voltage starts to increase according to a predetermined waveform.

At the same time, the output of the program stop line, to which the output of the data writing start/end control signal generator 150 is applied, is changed to a state in which current depending on the voltage of the data line can flow through the pixel circuit, and the output of the comparator 140 is reset.

Then, the reference signal, which determines the stop timing for data writing, is prepared. Since the voltage of the data line increases after time "a", the current of the data line increases as in FIG. 4C.

Upon reaching time "b", the current of the data line reaches a reference current level, and the output of the comparator 140 is inverted. The output of the data writing start/end control signal generator 150 is also inverted in response to the inverted signal, so that a certain current delivering path, which exists in the pixel circuit, is cut off.

Through the above-described operation, a data writing interval is clearly defined as time "c" of FIG. 4F.

When the voltage-current characteristics of drive transistors, which constitute pixels, differ from each other, only time "c" differs for respective pixels, and current levels written to respective pixels are identical to each other, thereby implementing the uniformity of brightness between pixels.

When the data writing ends at time "b", the level of the pixel current of FIG. 4D is identical to the reference current level. All of the pixel circuits adjust the reference current levels, so that data can be written at an intended current level. Therefore, the non-uniformity of brightness between pixels can be resolved.

FIG. 5 is a diagram illustrating an example of a reference signal generation unit 160 for generating a reference signal that determines the stop timing for the data writing of FIG. 4F, in other to apply the drive circuit of the present invention to a data driver.

The reference signal generation unit 160 is constructed to receive n-bit digital data as an input and generate a reference current corresponding to the input data. The reference signal generation unit 160 may include a Digital-to-Analogue Converter (DAC) for receiving an n-bit digital signal as input and converting it to an analogue signal, and is constructed to receive the output of the timing generator 110.

When the drive circuit of the present invention is applied to a data driver, a basic unit, which constitutes each data channel, is A of FIG. 5.

The reference current, which is generated by the reference signal generation unit 160 of FIG. 5, allows the n-bit data to be received as input and enables different currents corresponding to the input data to be generated for respective channels. In this case, the comparator 140 of FIG. 3 takes the form of the current comparator 140*a*.

Furthermore, the present invention may use voltage information as the reference signal, which is illustrated in FIG. 6. The greatest difference between FIG. 5 and FIG. 6 is that the reference signal of FIG. 6 is voltage. For this reason, the comparator 140 of FIG. 3 must be a voltage comparator 140*b* that operates in voltage mode, and the output of the current level detector 130 must also be a voltage signal. However, the basic operation principle thereof is identical to that of FIG. 5.

FIG. 7 is a diagram illustrating an embodiment in which the present invention is applied to a pixel circuit When the scan line of a pixel circuit 200 enters a high (ON) state, and a data drive start signal is generated by the timing generator 110 of the drive circuit 100 of the present invention and is output to the program stop line via the data writing start/end control signal generator 150 as a program start signal, switch transistors M12 and M13, each of which is composed of an N-channel TFT, are turned on.

Furthermore, the sweep voltage signal generated by the sweep voltage generator 120 is applied to the data line through the current level detector 130. As time elapses, the gate-source voltage of a drive transistor M11 increases, so that the current flowing through the drive transistor M11, which is composed of an N-channel TFT, also increases.

When the increasing current reaches a predetermined current level, the output of the comparator 140 is inverted. Therefore, the signal applied to the program stop line via the data writing start/end control signal generator 150 is also inverted, so that the switch transistor M12 is turned off. At this time, voltage information which drives current corresponding to the reference current, can be stored in the capacitor C11 of the pixel circuit 200. The pixel circuit 200 is a basic unit of a display panel.

FIG. 8 is a diagram illustrating an embodiment of a data drive circuit to which the drive circuit of the present invention is applied.

When the data of each channel is input as n-bit digital data, each channel generates a reference current signal based on the data, and the drive current levels of pixels can be determined by the levels of respective reference current signals. Therefore, although the voltage-current characteristics of the drive transistors of respective pixels differ from each other, it is inconsequential.

In FIG. 8, when respective R, G, and B data are input in serial in synchronization with external clocks, a shift resistor and a sampling latch convert the serial data into n-bit parallel data and a holding latch allows the parallel data to be maintained for a frame time.

Furthermore, for an application of FIG. 8, when the reference signal of each data channel is a voltage signal as in FIG. 9, the outputs of a reference common voltage source 170, having a plurality of outputs, can be selected by respective channels and, therefore, the reference signals are independently selected for the respective channels. For this, a separate control unit (not shown) may be included.

As described above, when the current is written via the data line of display pixels using sweep voltage signals, the present invention senses the writing state of the current via the same data line and outputs control signals to respective pixels based on the amounts of the current sensed in real time, thereby writing current data into the pixels using a sufficiently large amount current, thus considerably shortening data writing time and improving the precision of data writing.

Furthermore, the present invention does not require a separate circuit for increasing data writing speed, thereby simplifying a data drive circuit.

Furthermore, the present invention monitors the amount of current applied to respective pixels through a data line, and feeds back a control signal to a pixel circuit to stop data program when the amount of current reaches a target value, so that currents which drive OLEDs are controlled to be uniform, even though the voltage-current characteristics of transistors, which drive the OLEDs of respective pixels, differ from each other, thereby achieving the uniformity of brightness between the pixels.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A driving method for automatic voltage output of an Organic Light Emitting Device (OLED), comprising the steps of:

sensing a writing state of current via a data line when writing current via the data line of display pixels using sweep voltage signals; and outputting control signals to the respective pixels based on amounts of the current sensed in real time, thereby driving the pixels at intended current levels.

2. A driving circuit for automatic voltage output of an OLED, comprising:

timing generation means for generating a data drive start signal;

sweep voltage generation means for generating a sweep voltage signal in response to output of the timing generation means;

current level detection means for sensing an amount of current, which flows into pixels, based on output of the sweep voltage generation means, and outputting a sensing result to a data line;

comparison means for comparing output of the current level detection means with a reference signal that determines stop timing for data writing, and outputting a comparison result; and data writing start/end control signal generation means for starting to operate in response to the output of the timing generation means, and generating data writing start and end control signals to a program stop line of a display panel.

3. The circuit as set forth in claim 2, wherein the comparison means is constructed to operate in voltage mode when the reference signal is a voltage type.

4. The circuit as set forth in claim 2, wherein the comparison means is constructed to operate in current mode when the reference signal is a current type.

5. The circuit as set forth in claim 2, wherein the data writing start/end control signal generation means includes a logical circuit, which is activated when a set terminal thereof is set in response to the output of the timing generation means, and a reset terminal of which is controlled in response to the output of the comparison means.

6. The circuit as set forth in claim 2, further comprising reference signal generation means for generating the reference signal which is input to the comparison means, the reference signal generation means comprising a Digital-to-Analogue Converter (DAC) for converting an n-bit digital data input to an analogue signal.

7. A data drive circuit to which the drive circuit of claim 2 is applied, wherein, when reference signals of respective channels are current signals, the respective channels generate reference current signals depending on n-bit digital data inputs of the respective channels, and current drive levels of pixels are set to the respective reference current signal levels.

8. A data drive circuit to which the drive circuit of claim 2 is applied, wherein, when reference signals of respective channels are voltage signals, outputs of a reference common voltage source, having a plurality of outputs, are selected by the channels and then the reference signals of the channels are independently selected.

* * * * *

UNITED STATES PATENT AND TRADEMARK OFFICE

CERTIFICATE OF CORRECTION

PATENT NO. : 7,605,792 B2
APPLICATION NO. : 11/367864
DATED : October 20, 2009
INVENTOR(S) : Son et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 816 days.

Signed and Sealed this

Fifth Day of October, 2010

David J. Kappos

David J. Kappos
*Director of the United States Patent and Trademark Office*